United States Patent [19]

Duplan et al.

[11] Patent Number: 4,914,923

[45] Date of Patent: Apr. 10, 1990

[54] METHOD OF COVERING ARTIFICIAL ALPINE- OR NORDIC-SKIING TRACKS WITH SNOW AND MEANS FOR IMPLEMENTING THE METHOD

[75] Inventors: Max Duplan, Champagne Au Mont D'Or; Pierre Girardin, Saint-Herblain, both of France

[73] Assignee: Le Froid Industriel York, S.A., Carquefou, France

[21] Appl. No.: 246,667

[22] PCT Filed: Dec. 3, 1987

[86] PCT No.: PCT/FR87/00483

§ 371 Date: Aug. 5, 1988

§ 102(e) Date: Aug. 5, 1988

[87] PCT Pub. No.: WO88/04394

PCT Pub. Date: Jun. 16, 1988

[30] Foreign Application Priority Data

Dec. 5, 1986 [FR] France ..... 86 17242

[51] Int. Cl.[4] ..... F25C 3/04

[52] U.S. Cl. ..... 62/71; 37/222; 62/235; 62/320; 272/56.5 SS

[58] Field of Search ..... 62/320, 235, 354, 71; 239/2.2; 272/56.5 SS; 37/219, 222, 223

[56] References Cited

U.S. PATENT DOCUMENTS

| | | | |
|---|---|---|---|
| 2,763,939 | 9/1956 | Zamboni | 62/235 X |
| 3,983,713 | 10/1976 | MacCracken | 62/66 |
| 4,050,169 | 9/1977 | Pasquier | 37/219 X |
| 4,345,439 | 8/1982 | Gundlach | 62/320 X |
| 4,359,831 | 11/1982 | Beeley | 37/258 |
| 4,538,369 | 9/1985 | Pasquier | 37/219 |
| 4,560,303 | 12/1985 | Haug et al. | 37/219 X |

FOREIGN PATENT DOCUMENTS

| | | |
|---|---|---|
| 317970 | 9/1974 | Austria . |
| 0363962 | 9/1981 | Austria . |
| 804005049 | 10/1980 | European Pat. Off. . |
| 813007135 | 9/1981 | European Pat. Off. . |
| 2065634 | 8/1971 | France . |
| 2277189 | 1/1976 | France . |
| 2370824 | 6/1978 | France . |
| 2422771 | 11/1979 | France . |
| 2564739 | 11/1985 | France . |
| 81/03353 | 11/1981 | PCT Int'l Appl. . |
| 86/02936 | 5/1986 | PCT Int'l Appl. . |
| 86/07373 | 12/1986 | PCT Int'l Appl. . |
| 0376531 | 5/1964 | Switzerland . |
| 0798290 | 7/1958 | United Kingdom . |
| 2186673 | 12/1986 | United Kingdom . |

*Primary Examiner*—William E. Tapolcai
*Attorney, Agent, or Firm*—Sandler & Greenblum

[57] ABSTRACT

Method for covering with snow artificial slopes for downhill or cross-country skiing, comprising the formation of an ice layer forming the bottom of the run, the on site production of snow by machining said ice layer by forming chips having a predetermined thickness, the keeping of the thickness of the ice layer forming the run bottom, the maintenance of the desired characteristics and quality of the snow. The machine for implementing such method comprises: a raisable curved blade (5) which is front-mounted for smoothing the snow surface; as a tool, a cylindrical cutter (7) provided with teeth and driven by a hydraulic motor (8) and housed in a casing (10) of which the bottom forms a vault and opens at the rear to deposit snow on the ground; as reconstitution means, a water sprinkling ramp (12) arranged under the vault; a comb (14) provided with tracers (25).

25 Claims, 2 Drawing Sheets

METHOD OF COVERING ARTIFICIAL ALPINE- OR NORDIC-SKIING TRACKS WITH SNOW AND MEANS FOR IMPLEMENTING THE METHOD

BACKGROUND OF THE INVENTION

1. Field of the Invention

The present invention relates to tracks for practising cross-country skiing.

2. Discussion of Background of Material Information

Cross-country skiing, an open-air sporting activity, is practised using special, very light equipment which allows one to slide on snow-covered terrain which is not particularly mountainous.

This sport is currently practised on tracks usually in the form of unidirectional snow tracks which link up to form a loop and which are regularly packed down and marked. The duration of snowfalls is the fundamental criterion as to the suitability for developing the practice of this sporting discipline. The threshold of one hundred and twenty days of guaranteed snowfalls appears, generally speaking, to be the optimum value for successful operation of a cross-country skiing zone. Below this limit, the lack of certainty of snowfalls no longer makes it possible to ensure the conditions of the entire economic sector, associated the practice of this sport.

It is known to create artificial snow-covered tracks by spraying, at the intended location, a mixture of air and water in the form of a mist, into the low-temperature ambient air using snow guns such as those described, for example, in the patent EP-80 400504.9 of the Applicant.

The patent EP 0034930 describes a different device, which also enables artificial skiing tracks to be created

SUMMARY OF THE INVENTION

This method consists in forming a layer of ice on a support arranged in the centre and all the way along the track. The snow is produced from this layer of ice by means of a device travelling along the support, which device comprises blades intended to scrape the layer of ice, as well means for dispersing the snow thus formed, on the track.

Such devices are specially designed for creating alpine-skiing tracks. Moreover, they have the drawback that they do not directly allow the properties of the snow to be maintained in any way nor do they allow the desired quality of this snow to be preserved. The system described in the patent EP 0034930 is, moreover, very costly and very complicated to implement.

There also exist various apparatus, such as those described, for example, in the patent FR 2,564,739 or AT-P-317,970, used for preparing skiing tracks. These apparatus, however, do not produce any snow; they are intended solely to prepare the snow already present at the location.

The object of the present invention is to ensure that skiing tracks and more particularly those intended for cross-country skiing are always and without fail covered with snow, whatever the external atmospheric conditions.

The present invention relates to a method of covering artificial alpine- or nordic-skiing tracks with snow by manufacturing snow from ice produced by refrigerating means.

According to the invention, this method consists:

in creating a layer of ice forming directly the base of the track;

in manufacturing the snow at the location by machining the said layer of ice so as to form particles of a given thickness depending on the light or heavier quality of the snow required, by means of a scraping, planing, milling or any other operation.

Still according to the invention, this method consists in maintaining the thickness of the layer of ice forming the base of the track by compensating for the layer removed during machining by spraying a screen of water at a correctly adjusted rate.

According to a special feature, the method consists in producing a surface condition with incisions or reliefs which increase the area of exchange between the refrigerating means and the compensating water.

Another particularly interesting feature consists in preserving the properties and quality of the snow, whatever the external temperature and humidity, by means of artificial ventilation consisting in the diffusion of fresh air over the surface of the snow in order to break up any films of ice which may form within the snow.

The invention also relates to the skiing track intended for implementing the method.

According to the invention, this track comprises a network of tubes forming a floor which is kept at a negative temperature by the circulation of a refrigerating or cooling fluid ensuring a uniform cooling action. The network of tubes, which constitutes the refrigerating surface, is placed on an insulating layer and covered with a thin layer of sand or any other protective material, or embedded in a concrete slab. The assembly is retained laterally by border members arranged in a continuous line delimiting the width of the track so as to prevent any dispersion of the materials forming the base of the said track, and so as to ensure that the water poured onto the said base is retained in order to obtain the required thickness of ice.

According to another feature, the border members are made of concrete or reinforced plastic material and have a cross-section comprising a vertical flange and a horizontal flange forming a seat, which extends outside the track. These border members may or may not be connected to each other transversely. The internal wall of the vertical flange has orifices arranged in a line and supplied with cold air via a pipe incorporated into the wall of the flange so as to ventilate the snow.

The invention also relates to the machine for implementing the method.

According to the invention, this machine comprises the equipment necessary for performing the operations defined by the method, which equipment is mounted on a conventional tractor and consists in a subassembly mounted, via a height adjusting device, on the rear of the said tractor, accommodating the tools for machining the upper surface of the ice, consisting of a milling cutter with a horizontal axis, arranged transversely, of the type consisting of a cylindrical barrel on which teeth or blades are mounted such that, when rotated, they act integrally along the length of the milling cutter. The subassembly mounted at the rear of the tractor also comprises a combing device intended to level the layer of snow. The whole assembly is located inside a housing which is open in the region of the milling cutter and forms a discharge duct.

According to a special feature, the milling cutter is driven in rotation by means of a variable-speed hydraulic motor supplied by a pump itself driven by the power take-off of the tractor.

Still according to the invention, the means for reconstituting the thickness of the layer of ice consist in a water spraying bar arranged downstream of the milling cutter, transversely underneath the arch formed by the bottom of the housing, and supplied by a tank loaded onto the rear of the tractor.

According to another feature, the front of this tractor is equipped with a curved blade, the horizontal bottom edge of which flattens out the surface of the snow. This blade is mounted so as to pivot about a horizontal axis, by means of a hydraulic jack, in order to remove and convey the snow from one point on the track to another.

BRIEF DESCRIPTION OF THE DRAWINGS

The invention will be further illustrated, without being limited in any way by the following description of the method and a possible embodiment of the machine, in conjunction with the accompanying drawings which show.

DETAILED DESCRIPTION

Figure 1:
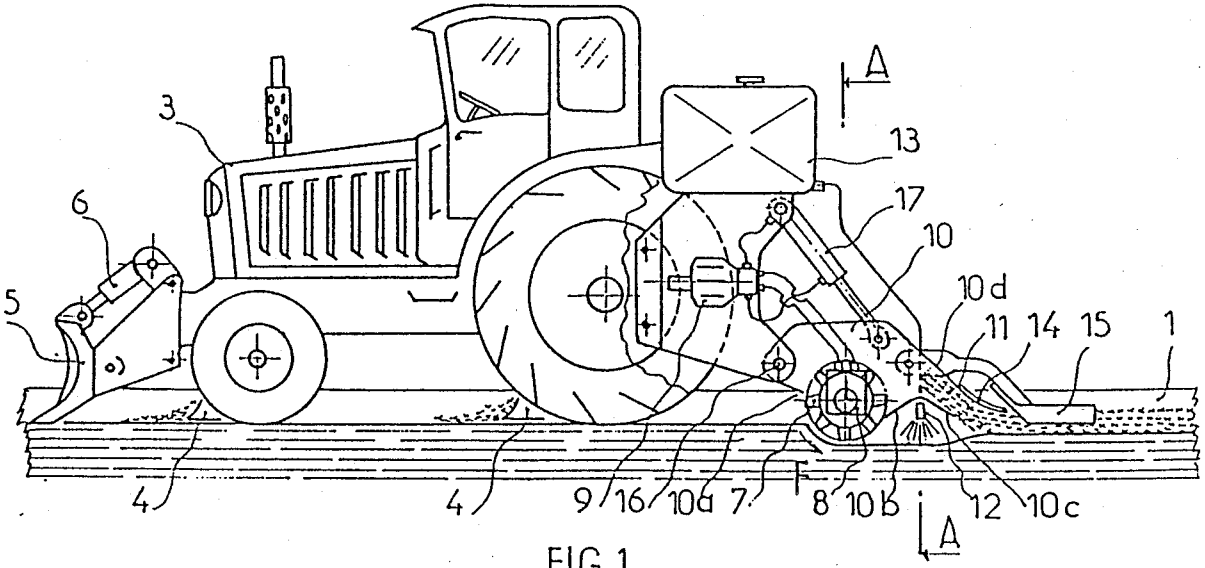
in FIG. 1, a partially sectioned, elevation view of the machine.
Figure 2:
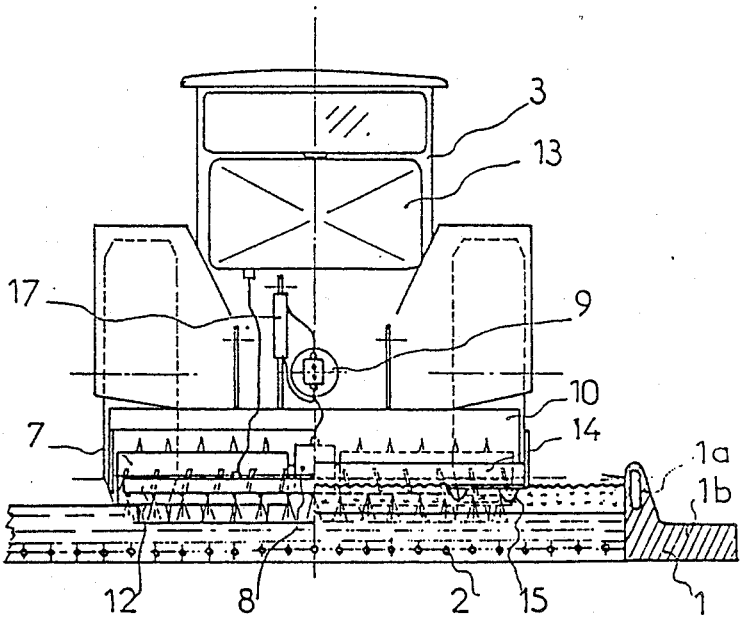
in FIG. 2, a rear view in an external half-view (sic) and half-section along the line AA.

As shown, the skiing track is delimited widthwise by border members 1 made of concrete or reinforced plastic material and having a profile consisting of a vertical flange 1*a* and a horizontal flange 1*b* forming a seat, which extends outside the track; the border members arranged in a continuous line may or may not be connected to each other transversely over the width of the track, the latter being generally between two and six meters. A bundle of tubes 2, constituting the device for manufacturing the layer of ice forming the base of the track, is arranged in the space separating the vertical flanges 1*a*.

The method which is the subject of the invention consists in ensuring under all conditions, on the one hand, the formation of a layer of ice and, on the other hand, the manufacture of snow from this layer of ice. The snow may then be maintained and preserved by various means described below.

The ice surface is obtained and maintained by the network of tubes, forming a floor, kept at a negative temperature by the circulation of a non-freezing refrigerating or cooling liquid so as to ensure a uniform cooling action. This network of tubes constituting the cold surface is placed on an insulating layer and may be covered with a thin layer of sand or any other protective material. The tubes may also be embedded in a concrete slab. The water introduced onto the track freezes owing to the action of the low-temperature refrigerating or cooling liquid flowing inside the network of tubes; the layer of ice thus obtained may have a thickness varying generally between two and five centimeters, or sometimes more in certain conditions. The border members are made from an insulating material so as to prevent the snow melting. The manufacture of snow from this layer of ice is performed by means of a surface machining operation such as scraping, planing, milling or any other operation of this kind, as a result of which it is possible to obtain particles of ice and a surface condition comprising incisions or reliefs which increase the area of exchange. The quality of the snow depends on the thickness of the particles, light snow being obtained from very fine particles, whereas larger particles produce heavier snow. The snow thus manufactured at the location is not subject to any handling. This machining operation is followed by reconstitution of the thickness of the ice layer by spraying a screen of water at a correctly adjusted rate. Repetition of these subsequent operations enables a layer of snow of adequate thickness for the skier to be obtained.

Thus, the layer of snow, in contact with the cold air generated by the surface of ice, retains its properties throughout most of its thickness.

The desired quality of snow is maintained, depending on the type of skiing to be practised on the track, by ventilating the snow so as to make it more malleable and break up the films of ice which could form owing to variations in the external atmospheric conditions. This ventilation of the snow may be performed by diffusing a stream of cold air over the surface, through orifices provided on the internal wall of the vertical flange 1*a* of the border members 1, linked to a supply bar located inside the said members. Moreover, it is conceivable to place a protective cover over the track during periods when it is not in use so as to prevent any loss of cold from the surface and preserve the quality of the snow. All of these operations may be performed with the aid of a special machine accommodating all the tools and necessary accessories.

The machine intended to manufacture the snow and reconstitute the ice layer consists of a conventional tractor 3 on which the equipment necessary for performing the operations defined by the method according to the invention is mounted. The wheels of the tractor are equipped with special tyres for travelling on ice: each of them has, in front, a shoe 4 intended to clear the snow. A curved blade 5 is arranged on the front of the tractor, its horizontal bottom edge being used to flatten out the surface of the snow; this blade, mounted so as to pivot about a horizontal axis by means of a hydraulic jack 6, also enables the snow to be coveyed from one point on the track to another.

A subassembly is mounted on the rear of the tractor and comprises:

the tools for machining the upper surface of the ice, the means for reconstituting the thickness of the layer of ice, the devices for combing and marking out the track.

In the example chosen, the machining tool is a milling cutter 7 with a horizontal axis arranged transversely, consisting for example of a cylindrical barrel on which teeth are mounted so that, when rotated, they are able to act integrally along the length of the milling cutter. The ends of the teeth are equipped with a contact point insert, made of tempered steel, for ensuring the manufacture of ice particles. The milling cutter is driven in rotation by a variable-speed hydraulic motor 8 supplied by a pump 9 itself driven by the power take-off of the tractor; the milling cutter is rotated in the direction of the arrow F so as not to brake the forward movement of the tractor. The milling cutter revolves inside a housing 10, the bottom of which has a cut-away part 10*a* necessary for the free movement of the milling cutter, which cut-away part is bordered by an upward sloping section 10*b* of the bottom followed by a downward sloping section 10*c*, the latter forming, together with a downward sloping section 10*d* of the top of the housing, a duct 11 for discharging the snow towards the ground. The sloping parts 10*b* and 10*c* of the housing bottom form an arch underneath which a water spraying bar 12 is arranged, supplied by a tank 13 loaded onto the rear of the tractor; the water thus diffused at the rear of the tool is transformed into ice when it comes into contact with the cold surface of the track base, so as to reconstitute the thickness of the latter. The snow ejected at the rear of the machine is then levelled with the aid of a comb 14 arranged at the outlet of the discharge duct 11; this comb may also be furnished with markers 15 intended to form the cross-country skiing tracks.

The subassembly thus formed is mounted so as to pivot about horizontal spindles 16 as a result of the action of a hydraulic jack 17. Such an arrangement enables the cutting depth of the milling cutter to be adjusted and, if necessary, the subassembly to be raised in order to perform other operations such as, for example, levelling with the aid of the blade 5 located at the front of the tractor, or unrolling of a plastic film or a protective cover over the track during periods when the latter is not being used.

Since the working width of the milling cutter is about two meters, it may be necessary, therefore, to perform two or three passes in order to cover the entire width of the track. So that the milling cutter can be used over its entire length, the drive motor 8 may be mounted at one of the ends of the said cutter. Similarly, the quantity of snow to be obtained will determine the number of passes, each of which must be performed after the water sprayed by the bar has been transformed into ice. The possibility of adjusting the height of the milling cutter also enables solely the volume of snow to be worked, without reaching the upper surface of the ice, in order to ventilate the snow and break up films of ice which may form within the snow, these operations aiming to preserve the desired quality of snow obtained previously by adjusting the speed of rotation and the cutting depth of the milling cutter.

The machining tool described above as a milling cutter may be replaced by a rotating plane with one or several blades able to achieve identical results.

This description of the machine is not limiting; it describes a possible embodiment of the machine for implementing the method, and any variations are possible provided that they do not go outside the scope of the invention.

The method which is the subject of the invention may be used for creating, maintaining and preserving the snow on all skiing, alpine skiing or cross-country skiing tracks, during any season.

The reference numbers inserted after the technical features mentioned in the claims have the sole purpose of facilitating comprehension of the latter and in no way limit the scope thereof.

We claim:

1. A process for producing artificial snow from ice comprising:

(a) providing a network of tubes with refrigerant maintained at a temperature sufficiently low to freeze water over a predetermined area;

(b) forming a layer of ice having a predetermined thickness over said network of tubes as a base of a ski run;

(c) disrupting at least a portion of said layer of ice to produce particles of said ice; and (d) removing said particles of ice from a remaining portion of said layer of ice and distributing said particles of ice as artificial snow over said base of said ski run.

2. The process of claim 1, further comprising supplying water to said remaining portion of said layer of ice to form a fresh top layer of ice before distributing said particles of ice as artificial snow on said fresh top layer of ice.

3. The process of claim 2, wherein said water is supplied in an amount sufficient to replenish the ice removed as particles of ice in order to maintain said predetermined thickness of said layer of ice.

4. The process of claim 3, wherein said water is supplied by spraying water over said remaining portion of said layer of ice.

5. The process of claim 2, wherein said disrupting and removing is performed by a technique selected from the group consisting of scraping, planing and milling.

6. The process of claim 5, wherein said technique disrupts at least a portion of said layer ice is a member selected from the group consisting of shavings and sheets of ice having selectively variable predetermined thicknesses related to desired characteristics of the artificial snow.

7. The process of claim 6, wherein said disrupting is performed in a manner which forms an irregular surface area on said remaining layer of ice after removing said particles of ice having an increased exchange surface for removing heat from said water.

8. The process of claim 1, further comprising aerating said artificial snow to minimize formation of films of ice within said artificial snow.

9. The process of claim 8, wherein said aerating is performed by diffusing air over the surface of said artificial snow.

10. The process of claim 3, further comprising aerating said artificial snow to minimize formation of films of ice within said artificial snow.

11. The process of claim 7, further comprising aerating said artificial snow to minimize formation of films of ice within said artificial snow.

12. The process of claim 11, wherein said aerating is performed by diffusing fresh air over the surface of said artificial snow.

13. The apparatus for forming a base of ice from which artificial snow is produced for covering a ski run, said apparatus comprising:

(a) a layer of insulating material;

(b) a network of tubes for refrigerant laid out over said layer of insulation material;

(c) protective material covering at least a portion of said network of tubes, wherein said layer, said network and said protective material form a foundation for a base of ice forming said ski run; and (d) border elements for laterally containing said foundation to prevent dispersion of materials forming said foundation for said base of ice and to insure retention of water when supplied over said foundation to obtain a requisite thickness of said base of ice, said border elements having means for introducing air in an area between said border elements over said foundation for aerating artificial snow distributed over a base of ice when formed over said foundation.

14. The apparatus of claim 13, wherein said border elements are made from material selected from the group consisting of concrete and reinforced plastic.

15. The apparatus of claim 14, wherein said border elements have a cross section comprising a vertical portion with an inner wall and a substantially horizontal portion having an upper surface extending outwardly from said vertical portion wherein said vertical portion includes an area higher than said upper surface of said substantially horizontal portion.

16. The apparatus of claim 15, wherein said means for introducing air comprises orifices in said inner wall.

17. The apparatus of claim 16, wherein said means for introducing air comprises a manifold in said area of said vertical portion, said manifold communicating with said orifices and being adapted for connection to an air source.

18. An apparatus for converting a layer of ice into ice particles distributed as artificial snow over a ski run, said apparatus comprising:

(a) means for removing at least a portion of a layer of ice as ice particles from a remaining layer of ice, said means for removing being supported in a housing;

(b) means for supplying water to form a fresh ice surface on said remaining layer of ice positioned within said housing downstream of said means for removing and connected to a source of water;

(c) means for distributing said ice particles as artificial snow onto said fresh ice surface positioned within said housing downstream of said means for supplying water, said means for distributing being in communication with said means for removing.

19. The apparatus of claim 18, wherein said means for removing comprises a tool for machining said at least a portion of said layer of ice.

20. The apparatus of claim 19, wherein said tool has a substantially horizontal longitudinal axis positioned transversely across a longitudinal axis of said casing.

21. The apparatus of claim 20, wherein said tool comprises a substantially cylindrical rotatable shaft having teeth for disrupting said at least a portion of said layer of ice as ice particles.

22. The apparatus of claim 21, further comprising a motor for rotating said shaft.

23. The apparatus of claim 22, further comprising means for combining said artificial snow over said fresh ice surface positioned downstream of said means for distributing said ice particles.

24. The apparatus of claim 22, further comprising attached upstream to said housing a tractor for pulling said housing, wherein said motor is a variable speed hydraulic motor fed by a pump, adapted to be operably connected to a power takeoff shaft of an engine of said tractor.

25. The apparatus of claim 24, further comprising a blade attached to said tractor upstream of said housing, said blade having a substantially horizontal lower edge and being pivotally mounted about a point on a horizontal axis to move snow from one area of the artificial ski run to another area of the artificial ski run.

* * * * *